US009315985B2

(12) United States Patent
Gosling et al.

(10) Patent No.: US 9,315,985 B2
(45) Date of Patent: Apr. 19, 2016

(54) CENTER-MOUNTED ACOUSTICAL SUBSTRATES

(71) Applicant: DIRTT Environmental Solutions, Ltd., Calgary (CA)

(72) Inventors: Geoff Gosling, Calgary (CA); Mogens F. Smed, DeWinton (CA)

(73) Assignee: DIRTT Environmental Solutions, LTD., Calgary, CA (US)

( * ) Notice: Subject to any disclaimer, the term of this patent is extended or adjusted under 35 U.S.C. 154(b) by 0 days.

(21) Appl. No.: 14/113,252

(22) PCT Filed: Oct. 4, 2013

(86) PCT No.: PCT/US2013/063488

§ 371 (c)(1),
(2) Date: Oct. 22, 2013

(87) PCT Pub. No.: WO2014/055883

PCT Pub. Date: Apr. 10, 2014

(65) Prior Publication Data

US 2015/0197934 A1 Jul. 16, 2015

Related U.S. Application Data

(60) Provisional application No. 61/710,592, filed on Oct. 5, 2012.

(51) Int. Cl.
*E04B 2/78* (2006.01)
*E04B 2/74* (2006.01)

(52) U.S. Cl.
CPC ..... *E04B 2/7414* (2013.01); *E04B 2/7422* (2013.01); *E04B 2/7409* (2013.01); *E04B 2002/7472* (2013.01); *E04B 2002/7477* (2013.01); *E04B 2002/7487* (2013.01)

(58) Field of Classification Search
CPC ..... E04B 2/7417; E04B 2/7422; E04B 2002/7477; E04B 2002/7472; E04B 2/7407; E04B 2/7409; E04B 2/7416; E04B 2/7433; E04B 2/7438; E04C 1/36; E04C 2002/004; E04C 2002/3488; E04C 2/36
USPC ..... 52/404.1, 404.3, 407.3, 479, 481.1, 52/481.2, 483.1, 489.1, 763, 770, 781
See application file for complete search history.

(56) References Cited

U.S. PATENT DOCUMENTS

| | | | |
|---|---|---|---|
| D26,071 | S | 9/1869 | Howland |
| 1,715,853 | A | 6/1929 | Madsen |

(Continued)

FOREIGN PATENT DOCUMENTS

| | | |
|---|---|---|
| EP | 1712694 | 10/2006 |
| JP | 02164984 | 6/1990 |

(Continued)

OTHER PUBLICATIONS

International Search Report and Written Opinion for PCT/US2013/063488 mailed Oct. 4, 2013.

(Continued)

*Primary Examiner* — Patrick Maestri
(74) *Attorney, Agent, or Firm* — Workman Nydegger

(57) ABSTRACT

A modular wall with acoustic properties including one or more wall modules arranged in a desired configuration, and methods of forming the same. The wall module includes a frame configured to receive a plurality of wall elements, and a plurality of wall elements attached to the frame. An acoustic substrate is secured to the frame by a ladder or ladder frame including horizontal support members coordinated between retaining members configured for attachment to the frame or elements thereof. The frame and ladder or ladder frame can be used to sandwich one or more acoustic substrates therebetween. Exterior wall, finishing, and trim elements can be attached to the horizontal support members, frame or frame elements, and other wall elements for structural and/or aesthetic purposes.

24 Claims, 9 Drawing Sheets

(56) References Cited

U.S. PATENT DOCUMENTS

| | | | | |
|---|---|---|---|---|
| D172,998 | S | 9/1954 | Sumner | |
| 2,996,157 | A | 8/1961 | Rauth | |
| 3,159,236 | A | 12/1964 | Akerson | |
| 3,174,580 | A | 3/1965 | Schulz | |
| 3,177,970 | A | 4/1965 | Boschi | |
| D204,057 | S | 3/1966 | Logan | |
| 3,526,065 | A | 9/1970 | Lee | |
| 3,770,560 | A | 11/1973 | Elder | |
| 4,076,100 | A | 2/1978 | Davis | |
| 4,269,005 | A | 5/1981 | Timmons | |
| 4,417,426 | A | 11/1983 | Meng | |
| 4,535,577 | A | 8/1985 | Tenser | |
| 4,546,591 | A | 10/1985 | Beltz | |
| 4,708,189 | A | 11/1987 | Ward | |
| D300,803 | S | 4/1989 | Whitley | |
| D306,689 | S | 3/1990 | Hamann | |
| 4,914,873 | A | 4/1990 | Newhouse | |
| D313,933 | S | 1/1991 | Petley | |
| 5,050,353 | A | 9/1991 | Rogers | |
| 5,134,826 | A | 8/1992 | La Roche | |
| 5,155,955 | A | 10/1992 | Ball | |
| 5,172,530 | A * | 12/1992 | Fishel | A47B 21/06 160/135 |
| 5,195,286 | A | 3/1993 | DeLong | |
| 5,297,368 | A | 3/1994 | Okada | |
| D348,384 | S | 7/1994 | Karsten | |
| 5,349,794 | A | 9/1994 | Taga | |
| 5,487,402 | A | 1/1996 | Clary | |
| 5,732,802 | A | 3/1998 | Tsukagoshi | |
| 5,735,100 | A | 4/1998 | Campbell | |
| 5,852,904 | A | 12/1998 | Yu | |
| 5,906,080 | A | 5/1999 | Digirolamo | |
| 5,934,028 | A | 8/1999 | Taylor | |
| D429,998 | S | 8/2000 | Snell | |
| 6,170,202 | B1 | 1/2001 | Davoodi | |
| 6,260,324 | B1 | 7/2001 | Miedema | |
| 6,434,895 | B1 | 8/2002 | Hosterman | |
| 6,598,351 | B2 | 7/2003 | Hallberg | |
| 6,679,016 | B2 | 1/2004 | Liu | |
| 6,889,477 | B1 | 5/2005 | Kottman | |
| 7,226,033 | B2 | 6/2007 | Foucher | |
| D569,713 | S | 5/2008 | Sandidge | |
| D576,475 | S | 9/2008 | Didehvar | |
| 7,466,286 | B2 | 12/2008 | Chapman | |
| 7,712,260 | B2 | 5/2010 | Vardaro | |
| 7,797,901 | B2 | 9/2010 | Near | |
| 7,926,430 | B2 | 4/2011 | Bakker | |
| 7,958,683 | B2 | 6/2011 | Abusada | |
| 8,015,767 | B2 | 9/2011 | Glick | |
| 8,033,059 | B2 | 10/2011 | Contois | |
| 8,046,957 | B2 | 11/2011 | Towersey | |
| D696,572 | S | 12/2013 | Petruccelli | |
| 8,601,749 | B2 | 12/2013 | Huene | |
| 8,613,168 | B2 | 12/2013 | Huene | |
| 8,615,936 | B2 | 12/2013 | Huene | |
| D699,547 | S | 2/2014 | Syed | |
| 8,813,455 | B2 | 8/2014 | Merrifield | |
| 8,899,519 | B2 * | 12/2014 | Smith | B64C 1/40 244/117 R |
| 2003/0154672 | A1 | 8/2003 | Spransy | |
| 2006/0057345 | A1 * | 3/2006 | Surace | B32B 7/12 428/213 |
| 2006/0059806 | A1 | 3/2006 | Gosling | |
| 2006/0157297 | A1 | 7/2006 | D'Antonio | |
| 2008/0302054 | A1 | 12/2008 | Gosling | |
| 2011/0100749 | A1 | 5/2011 | Nonogi | |
| 2011/0146180 | A1 | 6/2011 | Klein | |
| 2011/0147119 | A1 | 6/2011 | Cao | |
| 2014/0157720 | A1 | 6/2014 | Huene | |

FOREIGN PATENT DOCUMENTS

| | | |
|---|---|---|
| JP | 0925621 | 9/1997 |
| JP | 11050574 | 2/1999 |
| KR | 1020020037255 | 5/2002 |
| KR | 101143844 | 5/2012 |

OTHER PUBLICATIONS

International Search Report and Written Opinion for PCT/US2013/063580 mailed Jan. 17, 2014.

International Search Report and Written Opinion for PCT/US2013/063548 mailed Jan. 16, 2014.

Office Action for U.S. Appl. No. 14/114,019 mailed Aug. 7, 2015.

Non-Final Office Action for U.S. Appl. No. 14/722,642 mailed on Nov. 19, 2015.

* cited by examiner

CENTER-MOUNTED ACOUSTICAL SUBSTRATES

CROSS-REFERENCE TO RELATED APPLICATIONS

This application is a 35 U.S.C. §371 U.S. National Stage of PCT Application No. PCT/US2013/063488 titled "Center-Mounted Acoustical Substrates" filed Oct. 4, 2013, which claims priority to and the benefit of U.S. Provisional Patent Application Ser. No. 61/710,592 filed 5 Oct. 2012. The entire content of each of the aforementioned patent applications is incorporated herein by reference.

BACKGROUND OF THE INVENTION

1. The Field of the Invention

This invention relates to systems, methods, and apparatus for modular wall construction and design.

2. Background and Relevant Art

Environments that incorporate modular walls often sacrifice sound and other acoustical issues for ease of assembly and reconfiguration. One reason for this is that modular walls often do not span full floor-to-ceiling distances or otherwise close gaps between walls. In other cases, the types of walls suitable for modular construction are typically thinner walls, and in some cases much less dense than permanent walls. These thinner, less dense walls tend to be less effective at blocking sound.

Although modular walls can be assembled with acoustical advantages, walls pre-assembled with acoustic panels can be cumbersome, and in some cases, too heavy for installation. Specifically, many jurisdictions may place certain limits on the weight a worker can lift.

BRIEF SUMMARY OF THE INVENTION

Implementations of the present invention comprise systems, methods, and apparatus that enable construction of modular walls on-site with advanced acoustical properties. The constructed walls are simple to assemble, but yet are also structurally sound, even for environments susceptible to earthquake damage.

In at least one implementation, an acoustic wall module includes a frame and a plurality of wall elements configured for attachment to the frame. The frame includes a first vertical bracket and the plurality of wall elements includes: at least one acoustic substrate configured to inhibit sound from passing therethrough; at least one substrate retaining member configured to at least partially secure the acoustic substrate to the frame; at least one exterior wall element configured to substantially conceal from view at least a portion of the frame from a first vantage point; and at least one horizontal support member configured to at least partially secure the exterior wall element to the frame. According to certain implementations, the horizontal support member is attached to the frame, the exterior wall element is attached to the horizontal support member so as to substantially conceal from view at least a portion of the frame and horizontal support member from the first vantage point, the substrate retaining member is attached to the frame, and the acoustic substrate is at least partially secured to the frame through the substrate retaining member being attached to the frame.

In another implementation, an acoustic wall module includes: a frame having a first side and a second side; first and second acoustic substrates, the first acoustic substrate being securable to the first side of the frame, and the second acoustic substrate being securable to the second side of the frame; first and second substrate retaining ladder frames, the first substrate retaining ladder frame being configured to secure the first acoustic substrate to the first side of the frame, and the second substrate retaining ladder frame being configured to secure the second acoustic substrate to the second side of the frame; and first and second exterior wall elements, the first exterior wall element being connectable to the frame or the first substrate retaining ladder frame to substantially conceal from view at least a portion of the frame and the first acoustic substrate from a first vantage point, and the second exterior wall element being connectable to the frame or the second substrate retaining ladder frame to substantially conceal from view at least a portion of the frame and the second acoustic substrate from a second vantage point.

In another implementation, a method of assembling a modular acoustic wall is disclosed. The method includes providing a frame that includes a first vertical bracket, and providing a plurality of wall elements configured for attachment to the frame, the plurality of wall elements including: (a) at least one acoustic substrate configured to inhibit sound from passing therethrough; (b) at least one substrate retaining member configured to at least partially secure the acoustic substrate to the frame; (c) at least one exterior wall element configured to substantially conceal from view at least a portion of the frame from a first vantage point; and (d) at least one horizontal support member configured to at least partially secure the exterior wall element to the frame. In certain implementations, the method further includes attaching the substrate retaining member to the frame, securing the acoustic substrate to the frame by means of at least the substrate retaining member such that the acoustic substrate is at least partially secured to the frame through the substrate retaining member being attached to the frame, attaching the horizontal support member to the frame, and attaching the exterior wall element to the horizontal support member so as to substantially conceal from view at least a portion of the frame and horizontal support member from a first vantage point.

In another implementation, a system for assembling a modular acoustic wall is provided. The system includes a plurality of acoustic wall modules arranged in tandem, wherein one or more of the acoustic wall modules include a frame and a plurality of wall elements configured for attachment to the frame. In certain implementations, the frame includes a first vertical bracket, and the plurality of wall elements includes: at least one acoustic substrate configured to inhibit sound from passing therethrough; at least one substrate retaining member configured to at least partially secure the acoustic substrate to the frame; at least one exterior wall element configured to substantially conceal from view at least a portion of the frame from a first vantage point; and at least one horizontal support member configured to at least partially secure the exterior wall element to the frame. According to certain implementations, the horizontal support member is attached to the frame, the exterior wall element is attached to the horizontal support member so as to substantially conceal from view at least a portion of the frame and horizontal support member from the first vantage point, the substrate retaining member is attached to the frame, and the acoustic substrate is at least partially secured to the frame through the substrate retaining member being attached to the frame.

Additional features and advantages of illustrative and/or exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such illustrative and/or exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments and/or implementations thereof which are illustrated in the appended drawings. Understanding that these drawings depict only typical embodiments and/or implementations of the invention and are not therefore to be considered to be limiting of its scope, the invention will be described and explained with additional specificity and detail through the use of the accompanying drawings in which.

DETAILED DESCRIPTION OF THE PREFERRED IMPLEMENTATIONS

Implementations of the present invention comprise systems, methods, and apparatus that enable construction of modular walls on-site with advanced acoustical properties. The constructed walls are simple to assemble, but yet are also structurally sound, even for environments susceptible to earthquake damage.

Figure 1:
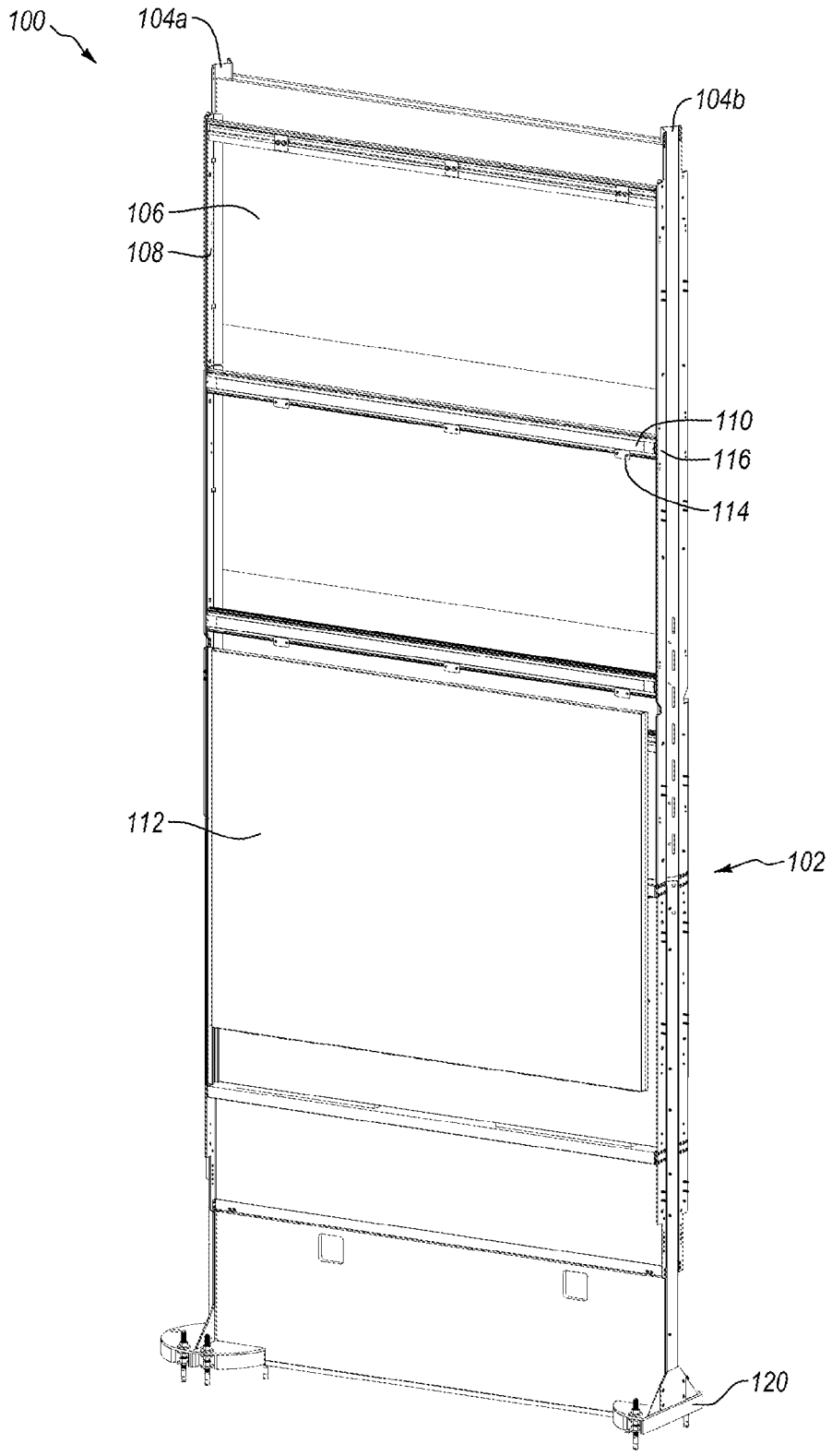
FIG. 1 illustrates a perspective view of a partially assembled acoustic wall module in accordance with an implementation of the present invention.

FIG. 1 illustrates an acoustic wall module 100 including a frame 102 according to an implementation of the present invention. In particular, FIG. 1 illustrates one or more sides of a wall module 100 during installation. One will appreciate that the opposing side (not shown) can comprise essentially the same components, but need not be identical in construction (e.g., number of frame and/or wall elements) on both opposing sides of wall module 100. As illustrated, frame 102 includes opposing first and second vertical brackets 104*a*, 104*b*, and is configured to receive the plurality of wall elements illustrated. One will appreciate, however, that the present disclosure is not limited to a frame including two vertical brackets. For instance, a frame according to certain implementations may include a single vertical bracket or more than two vertical brackets depending on the specific structural and/or aesthetic needs of the user.

In certain implementations, frame 102 and/or vertical brackets 104*a*, 104*b* may be formed of or otherwise comprise metal or a metal alloy. In other) implementations, however, frame 102 and/or vertical brackets 104*a*, 104*b* may be formed of or otherwise comprise any suitable material, known in the art or otherwise, which can be used to construct, build, or assemble such wall modules.

Frame 102 may also include a base elements 120 configured to support frame 102 in a substantially vertical position. In other implementations, however, base element 120 may be configured to support the frame 102 in any suitable orientation, direction, and/or position, including substantially horizontal or diagonal. As illustrated, base element 120 is attached to frame 102 at the bottom of each vertical bracket 104*a*, 104*b*, and is configured for attachment to a floor or subfloor member (not shown). In other implementations, however, base element 102 may be attached to any portion of frame 102 and/or wall module 100. Base element 102 may also be configured for attachment to a ceiling, wall, pillar, divide, or any other suitable structure, or may be configured to stand alone without attachment to other structural element(s). Furthermore, base element 120 may include a single base element, or a plurality of base elements or subunits as illustrated.

Acoustic wall module 100 may further include a plurality of wall elements, including at least one substrate or acoustic substrate 106. In certain implementations, acoustic substrate 106 may include a single sheet of fabricated medium-density fiberboard (MDF). One will appreciate, however, that the present disclosure is not so limited. For example, acoustic substrate 106 may include a plurality of substrate units that are assembled together into an acoustic substrate or a plurality of acoustic substrates 106. Acoustic substrate 106 may also include and/or be formed of any material suitable for construction, fabrication, and/or installation of a modular wall according to implementations of the present invention.

In certain implementations, acoustic substrate 106 may be configured to inhibit sound from passing therethrough. For instance, an acoustic substrate 106 according to at least one implementation may include and/or be formed of a material capable of substantially inhibiting sound and/or sound waves of a certain volume, decibel, wavelength, and/or magnitude (or range thereof) from passing therethrough. In such an implementation, the acoustic wall module 100 may function as a sound barrier and may provide an element of privacy to individuals on opposing sides of the acoustic substrate 106 and/or wall module 100. In some implementations, acoustic substrate 106 may also be configured such that it can be carried, installed, and or removed by a single person or a plurality of persons.

An acoustic substrate 106 according to certain implementations may be fabricated as a sheet, tile, board, or other elongated and substantially flat material. In other implementations, acoustic substrate 106 may include rounded, angled, circular, or other shape or a plurality thereof. Furthermore, substrate 106 may be fabricated in a variety of gauges or other measure of thickness. For instance, a substrate 106 according to some implementations may include one or more materials configured into a sheet or tile having a gauge of at least about 0.25 inches, at least about 0.5 inches, at least about 0.75 inches, at least about 1.0 inches, at least about 1.25 inches, and so forth. Other implementations may include a substrate 106 having a gauge of less than about 0.25 inches or a gauge greater than about 1.25 inches. At least one implementation includes a plurality of substrates 106, each having a suitable gauge or thickness for an intended purpose.

In at least one implementation, the plurality of wall elements further includes at least one substrate retaining member 108 configured to at least partially secure acoustic substrate 106 to the frame 102. As illustrated, substrate retaining member 108 may include at least one elongated bar, strip, column, or other element configured for attachment to at least one vertical bracket 104*a*. In certain implementations, however, substrate retaining member 108 may include a clip, plate, bracket, screw, bolt, tie, adhesive, fastener, or any other material suitable for securing an acoustic substrate 106 to the frame 102. Furthermore, a plurality of substrate retaining members 108 configured to at least partially secure one or more acoustic substrates 106 to one or more frames 102 and/or one or more vertical brackets 104*a*, 104*b* is also contemplated herein.

In some implementations, at least one exterior wall element 112 is also provided. In certain implementations, exterior wall element 112 is configured to substantially conceal from view at least a portion of frame 102, vertical brackets 104*a*, 104*b*, and/or plurality of wall elements (e.g., acoustic substrate 106), from a first vantage point. An exterior wall element 112 may include a single sheet, tile, board configured to cover a defined area. However, exterior wall element 112 may also or alternatively include a plurality of subunits that are assembled together into an exterior wall element or other wall exterior. A plurality of exterior wall elements 112 is also contemplated herein. Furthermore, exterior wall element 112 may include and/or be formed of any material suitable for construction, fabrication, and/or installation on a modular wall according to implementations of the present invention.

In certain implementations, exterior wall element 112 may include an aesthetic display or appearance. For example, exterior wall element 112 may include an outer surface that provides structural and/or aesthetic appeal suitable for a residential, commercial, industrial, governmental, educational, and/or other building or environment. Furthermore, the outer surface of exterior wall element 112 may function as an outer or exterior surface of a wall, divide, barrier, or other architectural and/or decorative structural element. Exterior wall element 112 may also or alternatively function as a ceiling, floor, subfloor, or any other architectural and/or decorative structural element.

In at least one implementation, the plurality of wall elements further includes at least one horizontal support member 110. In some implementations, horizontal support member 110 is configured to at least partially secure the exterior wall element 112 to the frame 102. As illustrated, horizontal support member 110 may include at least one elongated bar, strip, column, or other element configured for attachment to at least one of vertical brackets 104*a*, 104*b* and/or substrate retaining member 108. In certain implementations, however, horizontal support member 110 may include a clip, plate, bracket, screw, bolt, tie, adhesive, fastener, or any other material suitable for securing an exterior wall element 112 to the frame 102. Furthermore, a plurality of horizontal support members 110 configured to at least partially secure one or more exterior wall elements 112 to one or more frames 102 and/or one or more vertical brackets 104 is also contemplated herein.

In one or more implementations, horizontal support member 110 is attached to frame 102, and exterior wall element 112 is attached to horizontal support member 110 so as to substantially conceal from view at least a portion of frame 102, vertical brackets 104*a*, 104*b*, and/or one or more of the plurality of wall elements (including acoustic substrate 106, substrate retaining member 108, and/or horizontal support member 110) from at least a first vantage point. Exterior wall element 112 may be attached to horizontal support member 110 via an attachment member 114.

One will appreciate, however, that the present disclosure is not so limited. For instance, horizontal support member 110 may also or alternatively be attached to vertical brackets 104*a*, 104*b* and/or substrate retaining member 108, and exterior wall element 112 may also or alternatively be attached to frame 102, vertical brackets 104*a*, 104*b*, and/or substrate retaining member 108. Furthermore, exterior wall element 112 may be attached to horizontal support member 110 directly, through an attachment mechanism involving slotted and/or interlocking attachment members, frictional and/or gravitational forces, or any other suitable mechanism of direct attachment. Exterior wall element 112 may also or alternatively be attached to horizontal support member 110 indirectly via at least one clip, plate, bracket, screw, bolt, tie, adhesive, fastener, or any other material suitable for securing and/or attaching an exterior wall element 112 to a horizontal support member 110.

According to some implementations, one or more horizontal support members 110 may be coordinated by first and second substrate retaining members 108 such that the respective first ends of the one or more horizontal support members 110 are attached to the first substrate retaining member 108 and the respective second ends of the plurality of horizontal support members 110 are attached to the second substrate retaining member (not shown). For example, the first and second substrate retaining members 108 and the coordinated plurality of horizontal support members 110 may comprise or form a ladder or ladder frame (see e.g. ladder or ladder frame 880, FIG. 8). Furthermore, the ladder frame may be directly and/or indirectly attached to the frame by means of the first and second substrate retaining members. One will appreciate, however, that the disclosure is not so limited, and that direct attachment of one or more components is also contemplated herein.

In an illustrative implementation, at least a first portion of the first substrate retaining member 108 abuts and/or attaches directly to the first vertical bracket 104*a*, and at least a first portion of the second substrate retaining member (not shown) abuts and/or attaches directly to the second vertical bracket 104*b*. The present disclosure, however, is not limited to direct attachment and/or abutment of components. Furthermore, the acoustic substrate 106 may be positioned between the vertical bracket 104*a*, 104*b* and at least respective second portions of the substrate retaining members 108, such that the ladder or ladder frame secures the acoustic substrate 106 to the frame 102. In certain implementations, the acoustic substrate 106 is at least partially secured to the frame 102 through one or more of (a) a compressive force, (b) a frictional force, (c) an adhesive, and (d) a fastener. For example, acoustic substrate 106 may be at least partially secured to the frame 102 through a compressive force applied by the substrate retaining members 108 (optionally of the ladder or ladder frame) and by the vertical bracket 104*a*.

In some implementations, horizontal support member 110, whether considered alone or as part of a ladder or ladder frame, may be attached to frame 102, vertical brackets 104*a*, 104*b*, and/or substrate retaining member(s) 108 via one or more fasteners 116. Fastener 116 may include a bolt, screw, rivet, or other hardware configured to secured two elements together by passing into and/or through both elements. One will appreciate, however, that a fastener 116 according to the present disclosure is not so limited. For instance, a fastener 116 may also or alternatively include a clip, bracket, tie, adhesive, fastening member, or any other material suitable for securing and/or attaching a horizontal support member 110 to a frame 102. Furthermore, a fastener 116 may attach horizontal support member 110 to frame 102 by any suitable mechanism. Substrate retaining member 108 may also be attached to the frame 102 and/or vertical brackets 104*a*, 104*b* via a fastener 116.

In certain implementations, horizontal support member 110 comprises a first end and a second end. As illustrated, the first end of the horizontal support member 110 may be attached to the first vertical bracket 104*a* and the second end of the horizontal support member 110 may be attached to the second vertical bracket 104*b*. One will appreciate, however, that the present invention is not so limited and that horizontal support member 110 may be attached to frame 102 by or through any suitable mechanism. In at least one implementation, the first end of horizontal support member 110 is attached to a first substrate retaining member 108, and/or the second end of the horizontal support member 110 is attached to a second substrate retaining member (not shown).

Figure 2:
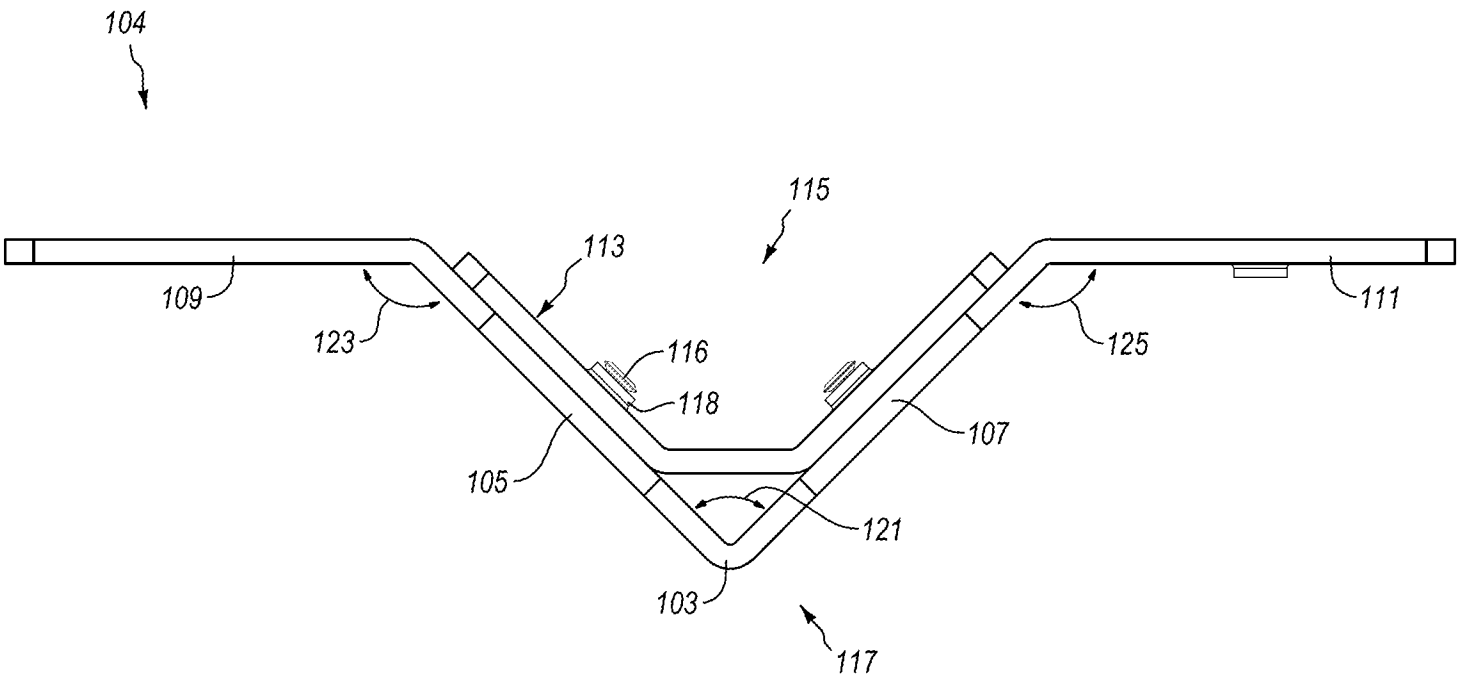
FIG. 2 illustrates a top cross-sectional view of a vertical bracket of the acoustic wall module shown in FIG. 1.

FIG. 2 illustrates a top, cross-sectional view of a vertical bracket 104 according to an implementation of the present invention. In at least one illustrative implementation, the vertical bracket 104 comprises an angled configuration providing a plurality of surfaces in a plurality of planes, and the plurality of surfaces may be configured for attachment of a plurality of frame and/or wall elements. Vertical bracket 104 may include, form, and/or otherwise be configured in a V-shape configuration, including a V-shaped element 103 that includes a first arm 105 and a second arm 107 arranged at an angle 121 such that the vertical bracket 104 includes a concave portion 115 and a convex portion 117. One will appreciate, however, that other configurations, including, flat, straight, rounded, and/or other various angled configurations, are also contemplated herein.

Vertical bracket 104 may also include a first extension element 109 extending from the first arm 105 at an angle 123 and in a first direction. Vertical bracket 104 may also include a second extension element 111 extending from the second arm 107 at an angle 125 and in a second direction such that the vertical bracket comprises, includes, forms, and/or is configured in a partially flattened M-shape configuration. In some implementations, the second direction in which the second extension element 111 extends is opposite the first direction in which the first extension element 109 extends and/or the first and second extension elements 109, 111 of the vertical bracket 104 are each configured for attachment of horizontal support members (not shown).

In an illustrative implementation, a bracket reinforcement member 113 may be attached to the concave portion 115 of the vertical bracket 104. The bracket reinforcement member 113 may be configured to support the first arm 105 and the second arm 107 and to prevent the angle 121 at which the first arm 105 and a second arm 107 are arranged from changing substantially in at least a first direction. One will appreciate, however, that bracket reinforcement member 113 may be configured and/or attached to support vertical bracket 104 in any suitable manner. For instance, bracket reinforcement member 113 may be attached to the convex portion 117, another portion, or a plurality of portions of the vertical bracket 104. In at least one implementation, bracket reinforcement member 113 is attached to the concave portion 115 of the vertical bracket 104 via at least one fastener 116 and via opening 118. One will appreciate, however, that use of fastener 116 and opening 118 are illustrative only, and that any suitable means of attachment is contemplated herein.

Figure 3:
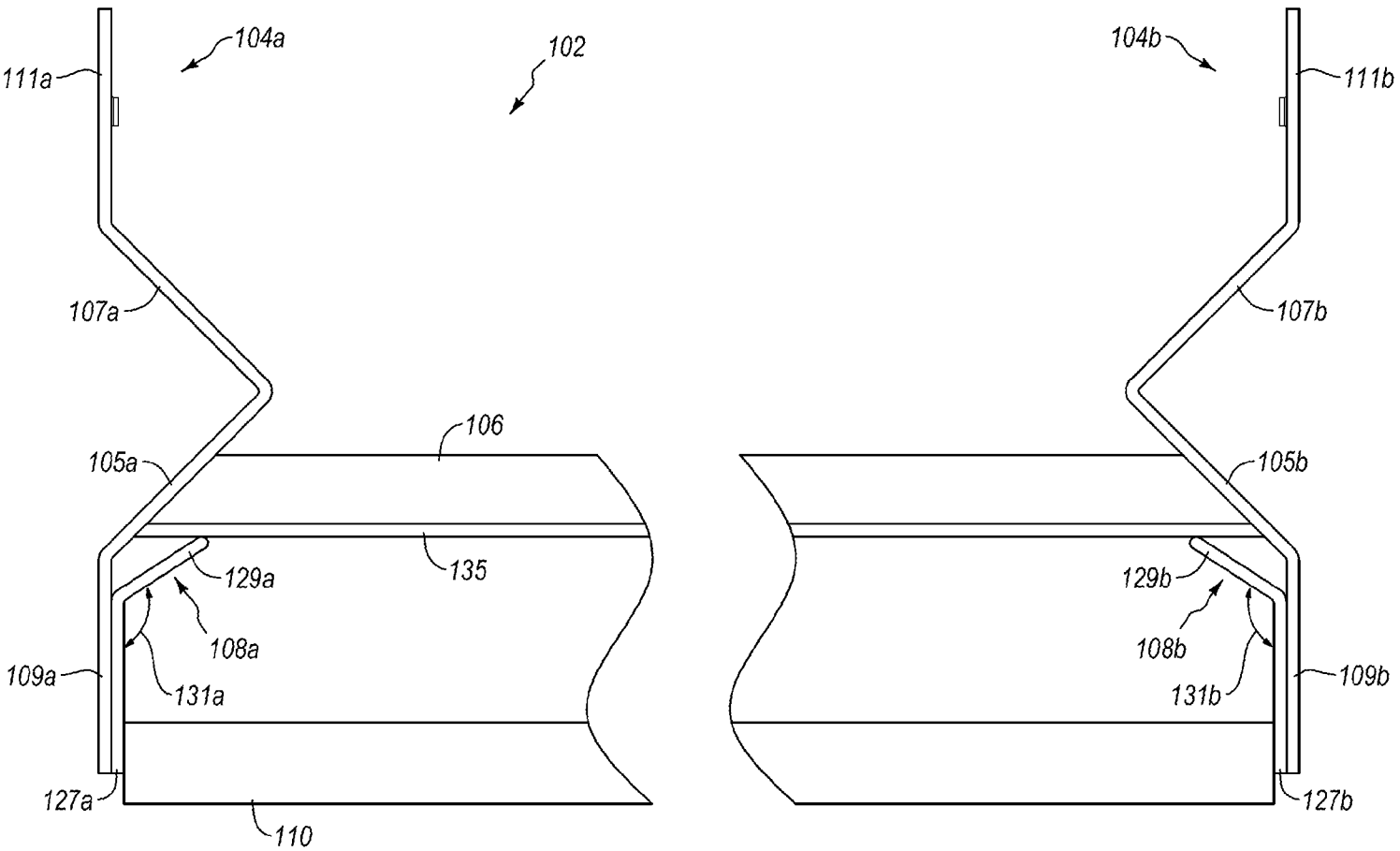
FIG. 3 illustrates a top cross-sectional hybrid compilation view of certain features of the acoustic wall module shown in FIG. 1.

As illustrated in FIG. 3, an implementation may include one or more acoustic substrates 106 positioned between first and second vertical brackets 104*a* and 104*b* of frame 102. Illustratively, acoustic substrate 106 is at least partially secured to frame 102 and/or vertical brackets 104*a*, 104*b* through substrate retaining members 108*a*, 108*b* being attached to the frame 102 and/or vertical brackets 104*a*, 104*b*. For example, substrate retaining member 108*a* may secure acoustic substrate 106 to frame 102 by pinching and/or pressing a first end of acoustic substrate 106 against the first vertical bracket 104*a*. Likewise, substrate retaining member 108*b* may secure acoustic substrate 106 to frame 102 by pinching and/or pressing a second end of acoustic substrate 106 against the second vertical bracket 104*b*.

One will appreciate, however, that the present invention is not so limited. For instance, an acoustic substrate 106 may be secured to a frame 102 and/or a vertical bracket 104*a*, 104*b* via a fastener. Furthermore, an acoustic substrate 106 may be at least partially secured to a frame 102 and/or a vertical bracket 104 through a single substrate retaining member 108 or a plurality of substrate retaining members being attached to the frame 102 and/or one or more vertical brackets 104*a*, 104*b*. In one or more implementations, the acoustic substrate 106 may be positioned between at least one substrate retaining member 108*a*, 108*b* and at least one first arm 105*a*, 105*b* of one or more vertical brackets 104*a*, 104*b* of frame 102.

In certain implementations, the substrate retaining members 108*a*, 108*b* may have angled configurations, respectively. An illustrative substrate retaining member 108*a*, 108*b* may also include a plurality of arms configured at one or more angles. For instance, substrate retaining members 108*a*, 108*b* may include first arms 127*a*, 127*b* and second arm 129*a*, 129*b*, arranged at angles 131*a*, 131*b*, respectively. In at least one implementation, angle 131*a* is substantially similar to angle 131*b*. In other implementations, however, angle 131*a* may be a different angle than angle 131*b*. Furthermore, angles 131*a*, 131*b* may be about 90 degrees, greater than 90 degrees, or less than 90 degrees. In other implementations, however, substrate retaining members 108*a*, 108*b* may have straight, rounded, blocked, symmetrical or other configurations without departing from the scope of this disclosure.

Illustratively, at least the first arms 127*a*, 127*b* of substrate retaining members 108*a*, 108*b* may include first and second opposing surfaces. The first surfaces may be attached to the horizontal support member 110 and the second surfaces may be attached directly to the first extension elements 109*a*, 109*b* of the vertical brackets 104*a*, 104*b* such that at least respective portions of the first arms 127*a*, 127*b* of the substrate retaining members 108*a*, 108*b* are positioned between the horizontal support member 110 and at least respective portions of vertical brackets 104*a*, 104*b*. One will appreciate, however, that other configurations, including attachment to other parts, portions, elements, and/or members are contemplated herein. For example, horizontal support member 110 may be attached directly or indirectly to vertical brackets 104*a*, 104*b* and/or first extension elements 109*a*, 109*b*. Similarly, substrate retaining members 108*a*, 108*b* may be attached to various surfaces and/or parts of the frame 102, the vertical brackets 104*a*, 104*b*, and/or the plurality of wall elements without departing from the scope of this disclosure.

In one or more implementations, at least part of the acoustic substrate 106 may be positioned between at least respective portions of the second arms 129*a*, 129*b* of the substrate retaining members 108*a*, 108*b* and the first arms 105*a*, 105*b* of the vertical brackets 104*a*, 104*b* such that the acoustic substrate 106 is pressed against at least a part of the convex portions 117 (see FIG. 2) of vertical brackets 104*a*, 104*b*. Acoustic substrate 106 may be held and/or secured against vertical brackets 104*a*, 104*b* by a force exerted by at least part of substrate retaining members 108*a*, 108*b*. For instance, second arms 129*a*, 129*b* of the substrate retaining members 108*a*, 108*b* may apply a force to acoustic substrate 106 in a first direction such that acoustic substrate 106 is held and/or secured to vertical brackets 104*a*, 104*b*. One will appreciate, however, that other configuration, including attachment to other parts, portions, elements, and/or members are contemplated herein. For example, acoustic substrate 106 may be positioned against and/or attached to the first extension elements 109*a*, 109*b* or the concave portions 115 (see FIG. 2) of the vertical brackets 104*a*, 104*b*, or other part(s) of the frame 102 without departing from the scope of this disclosure.

In at least one implementation, substrate retaining members 108*a*, 108*b* may include or otherwise be formed of a substantially rigid material, such as metal or metal alloy, illustratively. In other implementations, however, substrate retaining members 108*a*, 108*b* may include or otherwise be formed of a material possessing at least one flexible property. In certain implementations, substrate retaining members 108*a*, 108*b* may exhibit flexibility within a defined range of angles 131*a*, 131*b*, and substantial rigidity beyond the defined range. Properties related to material flex and/or flexibility are known in the art and contemplated herein. Furthermore, other angles and the like disclosed herein may include similar properties related to rigidity and/or flexibility as discussed herein.

In some implementations, acoustic substrate 106 may include one or more chamfered ends and/or edges. For instance, acoustic substrate 106 may include one or more chamfered end surfaces that corresponds in angle to the orientation and/or angle of first arms 105*a*, 105*b* of the vertical brackets 104*a*, 104*b* such that the one or more chamfered end surfaces are complimentary to the portion of the one or more vertical brackets 104*a*, 104*b* with which it intersects. Thus, acoustic substrate 106 may be configured for attachment to one or more vertical brackets 104*a*, 104*b* such that at least a first end or end surface of acoustic substrate 106 mates with at least a portion of one or more vertical brackets 104*a*, 104*b* with substantially similarity and/or congruity.

According to certain implementations, the acoustic substrate 106 is at least partially secured to first surfaces of the vertical brackets 104*a*, 104*b* and the horizontal support member 110 is attached to a second surface of the vertical brackets 104*a*, 104*b*. Thus, horizontal support member 110 may be attached to the first extension elements 109*a*, 109*b*, and may be attached to the substrate retaining members 108*a*, 108*b* such that the substrate retaining members 108*a*, 108*b* are respectively positioned between at least a portion of the horizontal support member 110 and vertical brackets 104*a*, 104*b*. One will appreciate, however, that the present disclosure is not so limited and that other configurations of various components of the wall module are contemplated herein.

In at least one implementation, acoustic substrate 106 is at least partially covered by an outer element 135. Thus, an outer element 135 according to certain implementations may cover at least a portion of one or more surfaces of acoustic substrate 106. Outer element 135 may include a vinyl layer configured to at least partially protect acoustic substrate 106 from damage caused by the impact, pressure, or contact of the second arms 129*a*, 129*b* of substrate retaining members 108*a*, 108*b* against acoustic substrate 106. An outer element 135 may also or alternatively serve other functions, protective or otherwise, without departing from the scope of this disclosure. An outer element 135 may also cover at least a portion of other surfaces of other elements disclosed herein.

Figure 4:
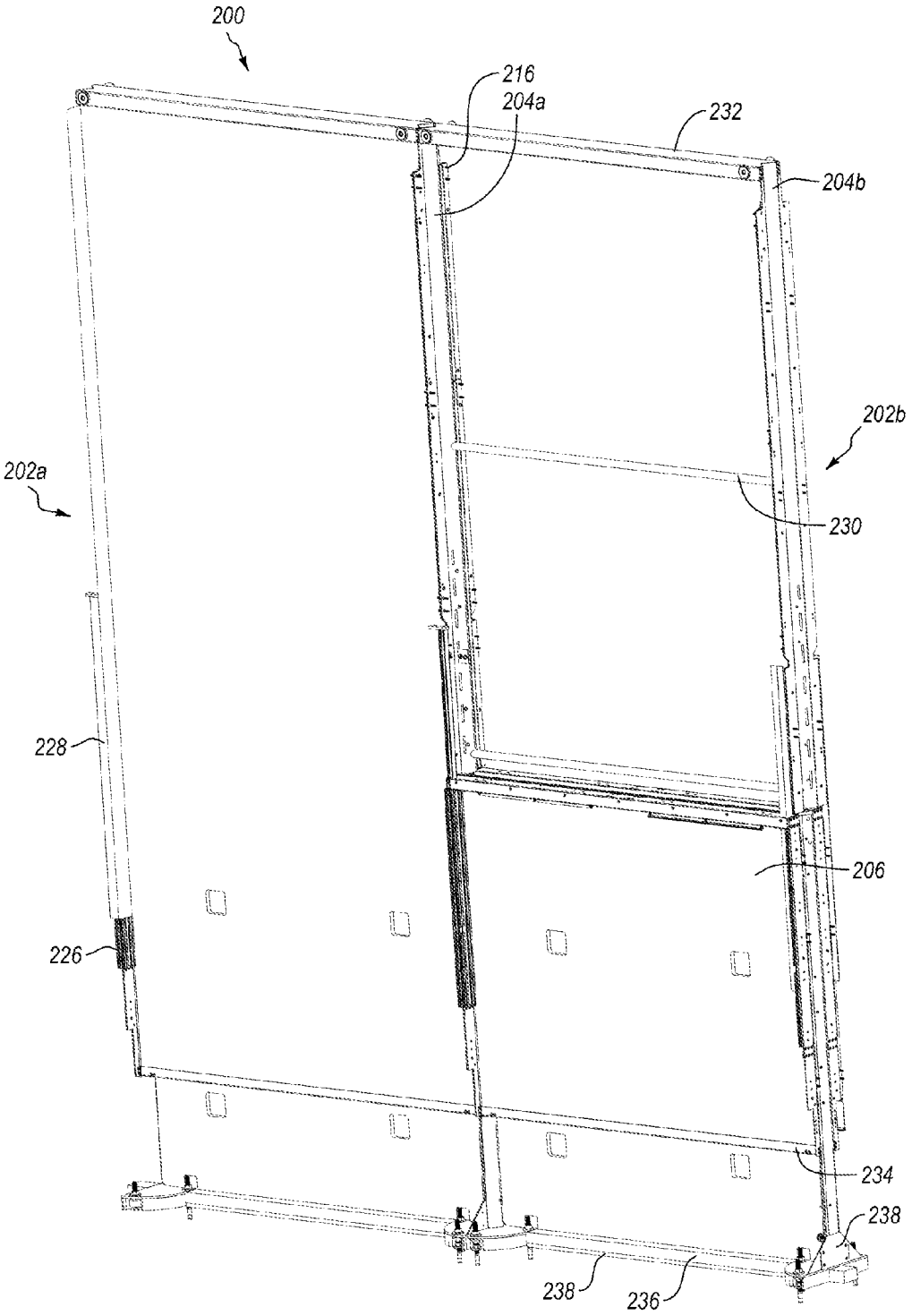
FIG. 4 illustrates a perspective view of a partially assembled modular acoustic wall in accordance with an implementation of the present invention.

FIG. 4 illustrates a partially assembled modular acoustic wall 200 in which a first frame or wall module 202*a* has been attached to a second frame or wall module 202*b* with one or more fasteners 216. As illustrated, frames 202*a* and 202*b* are aligned at a 180 degree angle such that frame 202*b* constitutes an extension of frame 202*a*. One will appreciate, however, that frames 202*a* and 202*b* may be positioned at other angles without departing from the scope of this disclosure.

In certain implementations, frame 202*b* of modular wall 200 may include a first vertical bracket 204*a* and a second vertical bracket 204*b* separated by a distance. In other implementations, however, frame 202*b* may include a single vertical bracket or more than two vertical brackets. In at least one implementation, frames 202*a* and 202*b* share at least one common vertical bracket. Frame 202*b* may also include at least one structural support member 230 positioned between first vertical bracket 204*a* and second vertical bracket 204*b*. Structural support member 230 may be configured to prevent frame 202*b* and/or vertical brackets 204*a*, 204*b* from moving substantially in one or more directions. In at least one implementation, structural support member 230 may include a torsion bar, a rod, a beam, or any other structural element configured to support the frame 202*b*.

According to some implementations, modular wall 200 may include one or more acoustic substrates 206 secured to the frames 202*a*, 202*b*. Furthermore, modular wall 200 may include an upper support element 232 and/or a lower support element 234 configured to at least partially secure frame 202*b* and/or vertical brackets 204*a* and 204*b* in a pre-determined or other configuration. Thus, a frame 202*b* according to some implementations may include a plurality of vertical brackets separated by a plurality of support elements configured to secure the vertical brackets into a frame-like structure. One will appreciate, however, that the present disclosure is not so limited and that other configurations are contemplated herein.

In one or more implementations, modular wall 200 may also include one or more spacer elements 228 configured to provide a buffer, pad, or cushion between elements of the modular wall 200. Modular wall 200 may also include one or more column members 226 configured for attachment to various structural and/or aesthetic elements of the modular wall 200. Modular wall 200 may also include one or more insulation members 236 and/or sealing members 238 configured to provide an appropriate degree of separation, divide, and/or insulation for or between elements disclosed herein.

Figure 5:
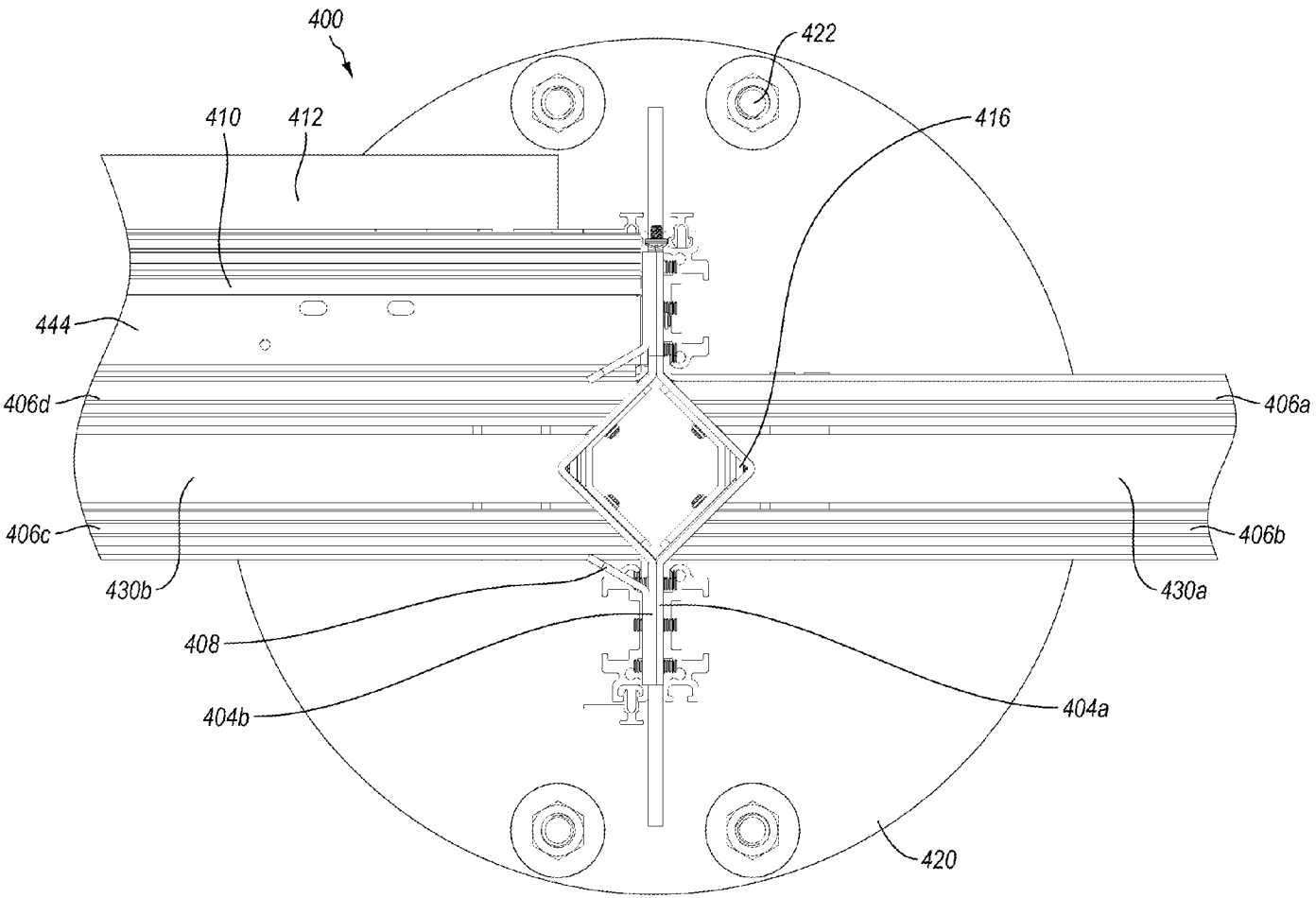
FIG. 5 illustrates a top cross-sectional view of certain features of the modular acoustic wall shown in FIG. 4.

FIG. 5 illustrates a top partial cross-sectional view of a modular wall 400 according to certain implementations of the present invention. Modular wall 400 may include at least a first vertical bracket 404*a* attached to a second vertical bracket 404*b*. Each vertical bracket 404*a*, 404*b* may have attached thereto a plurality of wall elements. As illustrated, structural support member 430*a* may be attached to a convex portion of vertical bracket 404*a* via fastener 416, and may extend away from vertical bracket 404*a* in a first direction. Similarly, structural support member 430*b* may be attached to a convex portion of vertical bracket 404*b* via a fastener, and may extend away from vertical bracket 404*b* in a second direction. In certain implementations, the first direction is opposite the second direction.

Modular wall 400 may also include one or more acoustic substrates secured to one or more of vertical bracket 404*a* and 404*b*. As illustrated, acoustic substrate 406*a* may be secured against a first surface of vertical bracket 404*a* similar to first arm 105*a*, 105*b* illustrated in FIG. 3. For instance, acoustic substrate 406*a* may be secured against a convex portion of vertical bracket 404*a*. Similarly, acoustic substrate 406*b* may be secured against a second surface of vertical bracket 404*a* similar to second arm 107*a*, 107*b* illustrated in FIG. 3. For instance, acoustic substrate 406*b* may be secured against a convex portion of vertical bracket 404*a*. In at least one implementation, acoustic substrates 406*a* and 406*b* are positioned on opposing sides of the V-shaped element of vertical bracket 404*a* and on opposing sides of the structural support member 430*a*. Likewise, acoustic substrate 406*c* may be secured against a first surface of vertical bracket 404*b* and acoustic substrate 406*d* may be secured against a second surface of vertical bracket 404*b* such that acoustic substrates 406*c* and 406*d* are positioned on opposing sides of structural support member 430*b*. One will appreciate, however, that such a configuration is illustrative only and that one or more acoustic substrates may be arranged, attached, and or secured to any suitable surface of any suitable element disclosed herein.

Modular wall 400 may also include at least one substrate retaining member 408 configured to secure one or more acoustic substrates 406 to one or more vertical brackets 404. In at least one implementation, each acoustic substrate 406*a*, 406*b*, 406*c*, 406*d* is secured to a corresponding vertical bracket 404*a*, 404*b* by at least one substrate retaining member 408. Furthermore, one or more substrate retaining members 408 may be attached to an extension element of vertical brackets 404*a*, 404*b*, similar to extension element 109*a*, 109*b* illustrated in FIG. 3. In at least one implementation, each substrate retaining member 408 may be attached to a corresponding extension element of a vertical bracket 404*a*, 404*b*, similar to extension elements 109*a*, 109*b*, 111*a*, 111*b* illustrated in FIG. 3. One will appreciate, however, that other configurations, including attachment, arrangement, or other forms of securing various elements are contemplated herein. For instance, one or more substrate retaining members 408 may be attached to an arm or other element of a vertical bracket 404 or other frame or wall element without departing from the scope of this disclosure.

Modular wall 400 may further include at least one inner support member 444 and at least one horizontal support member 410 attached to a frame and/or to one or more vertical brackets 404. In certain implementations, inner support member 444 and/or horizontal support member 410 may be attached to a substrate retaining member 408. Furthermore, modular wall 400 may also include one or more exterior wall elements 412 configured to substantially conceal from view at least a portion of modular wall 400 from at least a first vantage point.

In at least one implementation, each respective extension element of each vertical bracket 404*a*, 404*b*, similar to extension elements 109*a*, 109*b*, 111*a*, 111*b* illustrated in FIG. 3, has attached thereto at least one substrate retaining member 408, at least one horizontal support member 410, at least one inner support member 444, and/or at least one exterior wall element 412. Such a modular wall 400 may be configured in complete or partial symmetry relative to opposing sides of the modular wall 400.

Modular wall 400 may further include at least one base element 420 configured to support modular wall 400 in a substantially vertical position. In some implementations, each vertical bracket 404*a*, 404*b* has attached thereto at least one base element 420. Furthermore, base element 420 may be secured to a floor via fastening member 422. One will appreciate, however, that other configurations as set forth herein and known in the art are contemplated.

Figure 6:
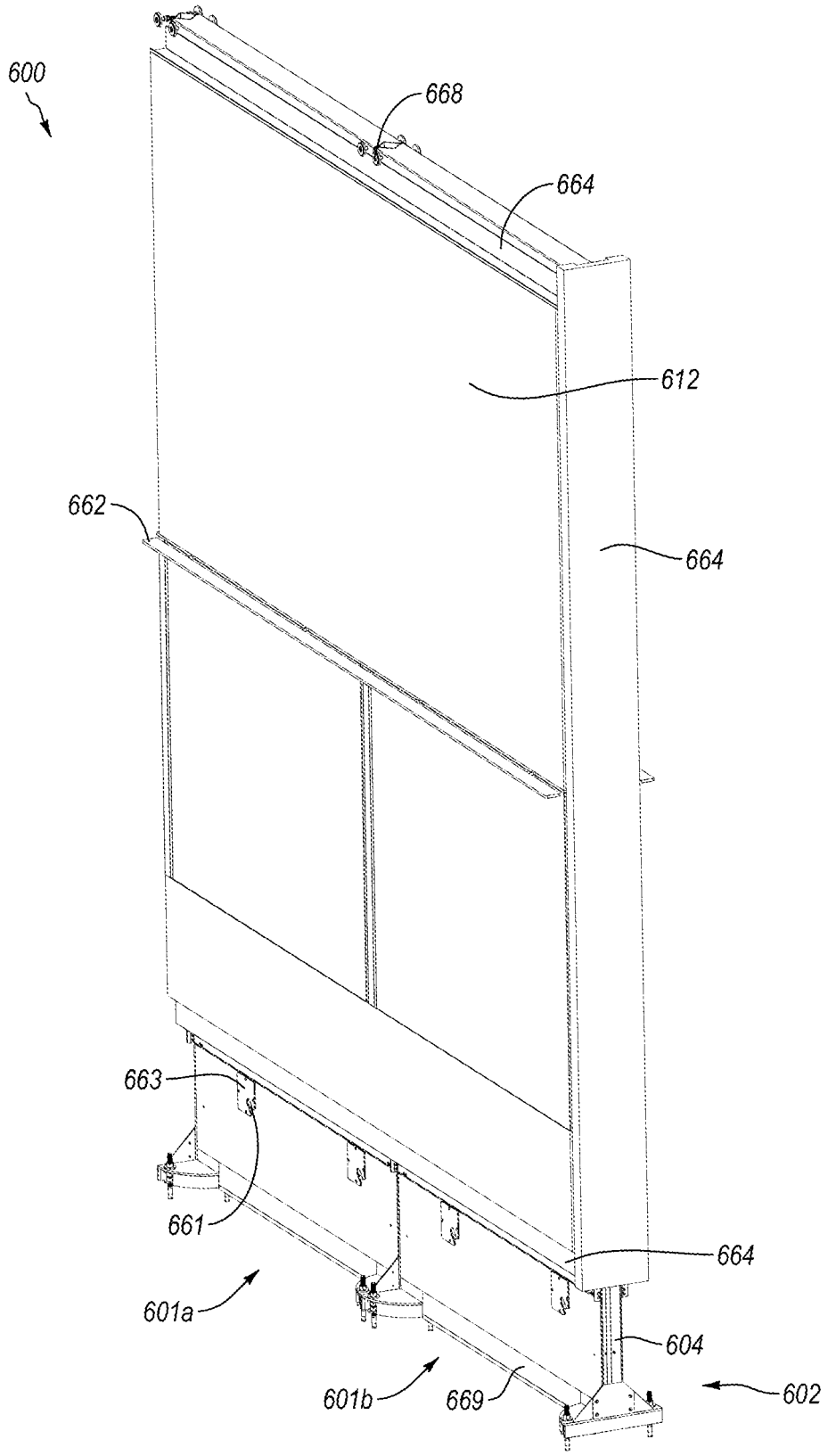
FIG. 6 illustrates a perspective view of a modular acoustic wall in accordance with an implementation of the present invention.

FIG. 6 illustrates a modular wall 600 according to an implementation of the present invention. Modular wall 600 may include a frame 602, including a plurality of vertical brackets 604 arranged in tandem and configured to support a plurality of wall elements. Modular wall 600 may also or alternatively include a plurality of frames or wall modules 601*a*, 601*b* connected and/or attached to one another. Modular wall 600 may further include one or more exterior wall elements 612 configured to substantially conceal from view at least a portion of modular wall 600 from at least a first vantage point.

In addition to features already disclosed herein, a modular wall 600 according to certain implementations may include one or more lighting elements 662 configured to provide a lighting effect to at least a portion of the modular wall. In certain illustrative implementations, lighting elements 662 may be secured to an exterior wall element 612 and/or another wall element(s). In other implementations, lighting elements 662 may be attached to the frame 602 and/or frame element(s).

Modular wall 600 may also include one or more trim elements 664 configured to provide an aesthetic or covering for the modular wall 600. In certain implementations, modular wall 600 may include a plurality of trim elements configured to cover one or more portions of the frame 602 and/or modular wall 600 that are not substantially concealed from view by an exterior wall element 612. For instance, a trim element 664 according to certain implementations may substantially conceal from view a portion of the modular wall 600, frame 602, frame element(s) and/or wall elements from one or more vantage points. In other implementations, trim elements 664 may be configured to prevent dust and debris from penetrating beyond the wall elements and into the inner, frame area of the modular wall 600.

Modular wall 600 may also include one or more openings 661, which may be at least partially covered by one or more covers 663. According to certain implementations, an opening 661 may provide a conduit through which cables, wires, pipes, rods, bars, or other matter may pass. Furthermore, an opening 661 may provide a receptacle to which an electrical or other outlet may be affixed. Cover 663 may be configured to at least partially seal opening 661 in the presence or absence of such a passing or affixed feature.

Modular wall 600 may further include one or more leveling elements 668 configured to adjust the orientation and/or interaction between elements of one or more modular walls 600. Modular wall 600 may also include one or more seals 669 configured to provide a protective barrier for at least a part of the modular wall 600.

Figure 7:
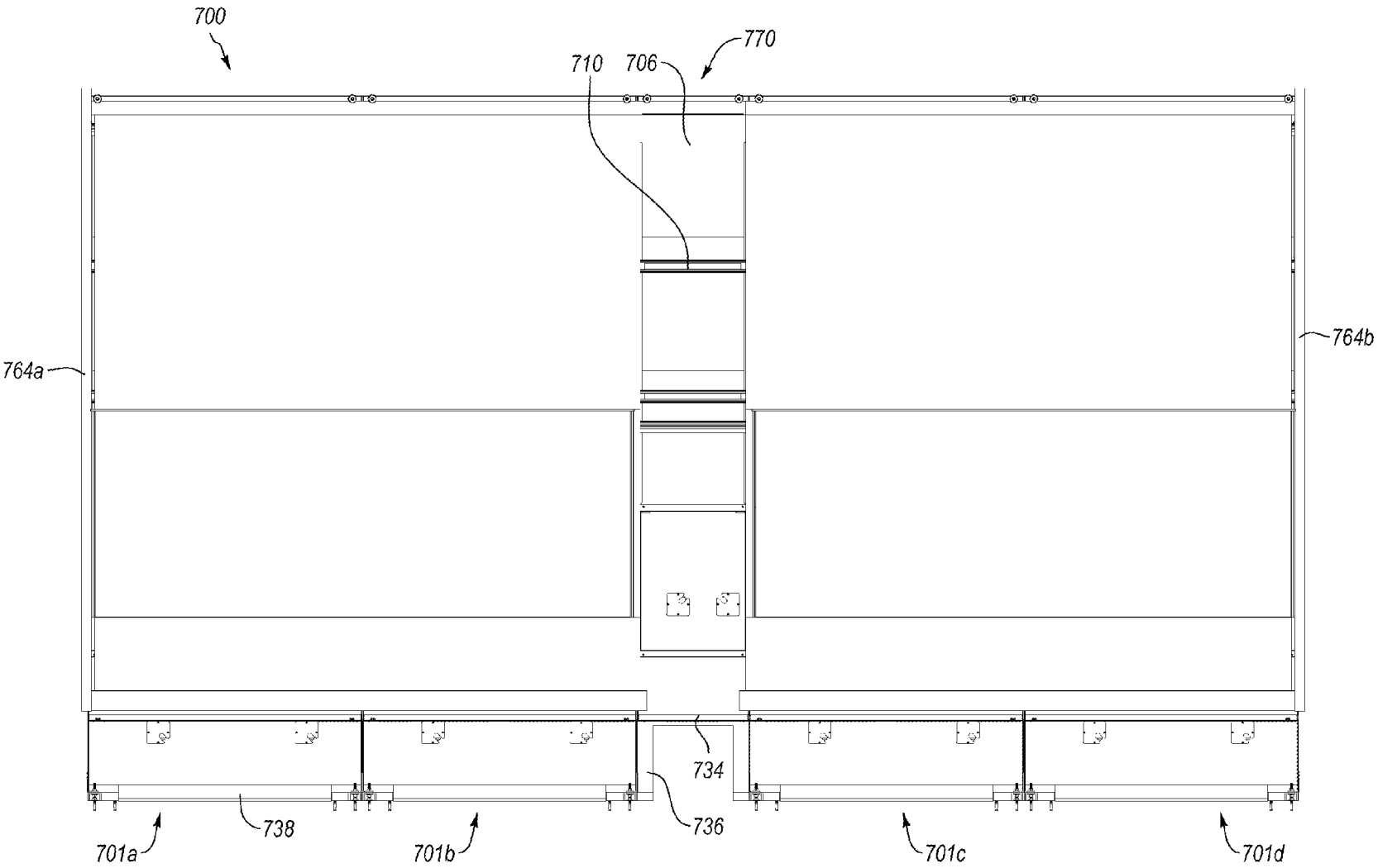
FIG. 7 illustrates a perspective view of a modular acoustic wall in accordance with another implementation of the present invention.

FIG. 7 illustrates a modular wall 700 according to an implementation of the present invention. Modular wall 700 may include a frame (not shown), including a plurality of vertical brackets (not shown) arranged in tandem and configured to support a plurality of wall elements. Modular wall 700 may also or alternatively include a plurality of wall modules 701*a*, 701*b*. 701*c*, 701*d* connected and/or attached to one another. Modular wall 600 may further include one or more exterior wall elements 712 configured to substantially conceal from view at least a portion of modular wall 700 from at least a first vantage point and one or more trim elements 764*a*, 764*b* configured to provide an aesthetic or covering for the modular wall 700.

In at least one implementation, modular wall 700 includes a transition region 770 characterized by an exposure of frame and/or internal wall elements. In an illustrative implementation, a plurality of exterior wall elements may cover a portion of modular wall 700 while leaving the transition region 700 uncovered. For instance, as illustrated, transition region 770 of modular wall 700 retains exposure of one or more acoustic substrates 706 and/or horizontal support members 710.

In at least one implementation, transition region 770 may serve as a point of intersection for a second and/or third modular wall (not shown). For instance, in certain implementations, a plurality of modular walls 700 may be arranged to provide separate rooms, areas, work spaces, and/or other divided regions. In an illustrative implementation, a second modular wall (not shown) may be attached to the front side of modular wall 700 so as to extend from the transition region 770 in a first direction. A third modular wall (not shown) may also or alternatively be attached to the rear side of modular wall 700 so as to extend from the transition region 770 in a second direction. Such second and/or third modular walls may intersect and/or extent from modular wall 700 at any suitable angle, including 90 degrees, greater than 90 degrees, or less than 90 degrees.

Modular wall 700 may also include one or more insulation members 736 and/or sealing members 738 configured to provide an appropriate degree of separation, divide, and/or insulation between elements disclosed herein. Modular wall 700 may also include one or more lower support elements 734 as discussed further herein in relation to lower support elements 234 of FIG. 4 and 834 of FIG. 8.

It is noted that a wall, wall module, or modular wall, according to an implementation of the present invention may include, incorporate, or otherwise comprise properties, features, components, members, and/or elements described in other implementations, including systems, methods, products, devices, and/or implementations of the same disclosed herein. Thus, reference to a specific feature in relation to one implementation should not be construed as being limited to applications within said implementation.

Figure 8:
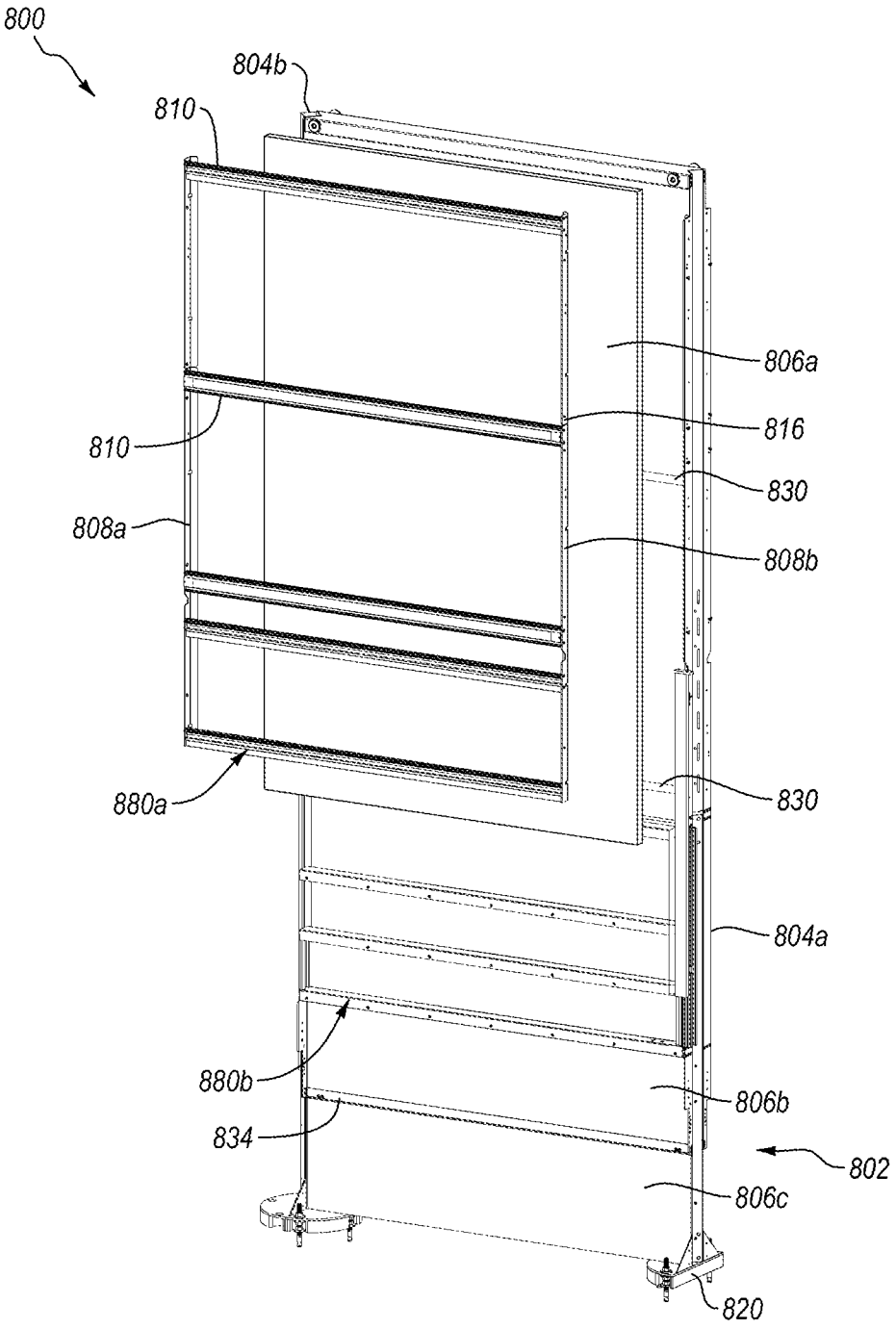
FIG. 8 illustrates a method of assembling and/or disassembling an acoustic wall module and/or modular acoustic wall in accordance with an implementation of the present invention.

Referring now to FIG. 8, certain implementations of the present invention include a method of assembling a modular acoustic wall. One or more implementations may include assembling at least one acoustic wall module 800, including a frame 802 and a plurality of wall elements. For instance, frame 802 may include at least one vertical bracket 804, which may be held in a substantially vertical position by at least one base element 820. An implementation of the present invention may further include attaching a plurality of wall elements to the frame 802.

One or more implementations may include attaching one or more structural support members 830 to the frame 802. Such structural support members may at least partially prevent elements of frame 802 from moving in at least a first direction. For instance, one or more structural support members may substantially prevent opposing vertical brackets 804*a* and 804*b* from moving closer together and/or further apart. Furthermore, one or more structural support members may also or alternatively prevent frame 802 from pivoting, twisting, or otherwise moving in an undesirable manner.

Certain implementations may include securing at least one acoustic substrate 806*a* to the frame 802. In at least one implementation, one or more ladder or ladder frames 880*a* (e.g., ladder or ladder frames 880*a*, 880*b*) are used to secure acoustic substrate 806*a* to the frame 802. As illustrated, ladder or ladder frame 880*a* includes a plurality of horizontal support members 810 coordinated by a first substrate retaining member 808*a* and a second substrate retaining member 808*b*. One will appreciate, however, that in certain implementations, a ladder or ladder frame 880*a* may include one or more horizontal support member 810 attached to one or more substrate retaining members 808*a*, 808*b* such that at least one element of the ladder or ladder frame 880*a* secures the acoustic substrate 806*a* to the frame 802 by attachment thereto.

In at least one implementation, substrate retaining members 808*a*, 808*b* may be configured such that angles similar to angles 131*a*, 131*b* illustrated in FIG. 3 may remain substantially unchanged throughout the illustrative method of assembling a modular acoustic wall or wall module. For instance, substrate retaining members 808*a*, 808*b* may include or otherwise be formed of a substantially rigid material, such as metal or metal alloy, illustratively. In other implementations, however, substrate retaining members 808*a*, 808*b* may be configured such that angles similar to angles 131*a*, 131*b* illustrated in FIG. 3 may increase and/or decrease during the illustrative method. For instance, substrate retaining members 808*a*, 808*b* may include or otherwise be formed of a material possessing at least one flexible property. In certain implementations, substrate retaining members 808*a*, 808*b* may exhibit flexibility within a defined range of angles, and substantial rigidity beyond said defined range of angles. Properties related to material flex and/or flexibility are known in the art and contemplated herein. Furthermore, other angles and the like disclosed herein may include similar properties related to rigidity and/or flexibility as discussed herein.

In an illustrative implementation, at least one ladder or ladder frame 880*a* is assembled. A ladder or ladder frames 880*a* may be assembled on or off the frame 802. In some implementations, a plurality of ladder or ladder frames 880*a*, 880*b*, each including a plurality of horizontal support members 810 coordinated by a first substrate retaining member 808*a* and a second substrate retaining member 808*b*, are assembled off of the frame, prior to complete assembly of the acoustic wall module 800 or modular acoustic wall. Respective first ends of the horizontal support members 810 are attached to a first surface or arm (see e.g., FIG. 3; first arm 127*a*) of a first substrate retaining member 808*a*, and respective second ends of the horizontal support members 810 are attached to a first surface or arm (see e.g., FIG. 3; first arm 127*b*) of a second substrate retaining member 808*b*. Furthermore, each of the horizontal support members 810 are attached at a different longitudinal position on the substrate retaining members 808*a*, 808*b* such that the horizontal support members 810 are suspended between the substrate retaining members 808*a*, 808*b* in a ladder-like formation.

One will appreciate, however, that the present invention is not so limited, and that other configurations of ladders or ladder frames are contemplated herein. Furthermore, in certain implementations, one or more substrate retaining members 808*a*, 808*b* may be used to secure the at least one acoustic substrate 806 to the frame 802 and/or vertical brackets 804*a*, 804*b*. Likewise, horizontal support members 810 may be attached to one or more substrate retaining members 808*a*, 808*b* and/or directly to the frame 802 and/or vertical brackets 804*a*, 804*b* without being assembled into a ladder or ladder frame 880*a*.

In an illustrative implementation, one or more acoustic substrates 806*a* are placed against frame 802 and/or vertical brackets 804*a*, 804*b*. The acoustic substrate 806*a* may be positioned by lifting the substrate and pushing it against the frame 802 and/or vertical brackets 804*a*, 804*b*. In another implementation, acoustic substrate 806 may be positioned by lifting the substrate and sliding it into place between elements of the frame 802 and/or vertical brackets 804*a*, 804*b* (see e.g., FIG. 9). In at least one implementation, frame 802 and/or vertical brackets 804*a*, 804*b* include one or more substrate securing elements (not shown) configured to retain the acoustic substrate at least temporarily.

An implementation of the present invention may also include securing the one or more acoustic substrates 806*a* to the frame 802 and/or vertical brackets 804*a*, 804*b* via one or more ladder or ladder frames 880*a*. A ladder or ladder frame 880*a* may be secured to the frame 802 and/or vertical brackets

804*a*, 804*b*, thereby securing the one or more acoustic substrates 806*a* to the frame 802 and/or vertical brackets 804*a*, 804*b*. Furthermore, a ladder or ladder frame 880*a* may be secured to the frame 802 and/or vertical brackets 804*a*, 804*b* via one or more fasteners 816.

In an illustrative implementation, the acoustic substrate 806 may be positioned against a surface, arm, extension element, or other portion of the vertical brackets 804*a*, 804*b*, similar to arm 105*a*, 105*b* illustrated in FIG. 3, and the ladder or ladder frame 880*a* may be attached to a separate surface, arm, extension element, or other portion of the vertical brackets 804*a*, 804*b*, similar to extension element 109*a*, 109*b* illustrated in FIG. 3. The attachment of the ladder or ladder frame 880*a* to the vertical brackets 804*a*, 804*b* may apply a compressive force against the acoustic substrate 806*a* such that the acoustic substrate 806*a* is pinched between at least a portion of the ladder or ladder frame 880*a* and at least a portion of the vertical brackets 804*a*, 804*b*.

In at least one implementation, an assembler can assemble a wall module 800 by placing at least one first acoustic substrate 806*b* at the bottom of wall module 800, and installing a first ladder or ladder frame 880*b* to hold the acoustic substrate 806*b* in place. The assembler can also place another sheet of acoustic substrate 806*a* on top of the first acoustic substrate 806*b* and install a second ladder or ladder frame 880*a* to hold the acoustic substrate 806*a* in place. One will appreciate, however, that other orders of assembly and/or installation are contemplated herein. For instance, in certain implementations, an upper acoustic substrate 806*a* may be installed first. In another implementation, a base acoustic substrate 806*c* may be installed in a lower portion of the frame 802 and/or wall module 800, illustratively below a lower support element 834.

In at least one implementation, an assembler can join the lower and upper acoustic substrates 806*a*, 806*b* by a tongue and groove or other connection, including any additional adhesives or fasteners. An assembler may also separate base acoustic substrate 806*c* from lower acoustic substrate 806*b* with a lower support element 834. In certain implementations, base acoustic substrate 806*c* is configured to be positioned beneath or below at least part of a floor or sub-floor. Upon assembly, the horizontal support members 810 of the ladder frames 880*a*, 880*b* become the horizontal support members of the wall module 800 on the previously "naked side." After installation of the one or more ladder or ladder frames 880*a*, 880*b*, the assembler can then place finishing elements on the wall module 800 by attaching any exterior wall elements or other sheets or tiles thereto. The exterior wall elements and/or finishing sheets or tiles can be structural or decorative in nature, as desired.

Figure 9:
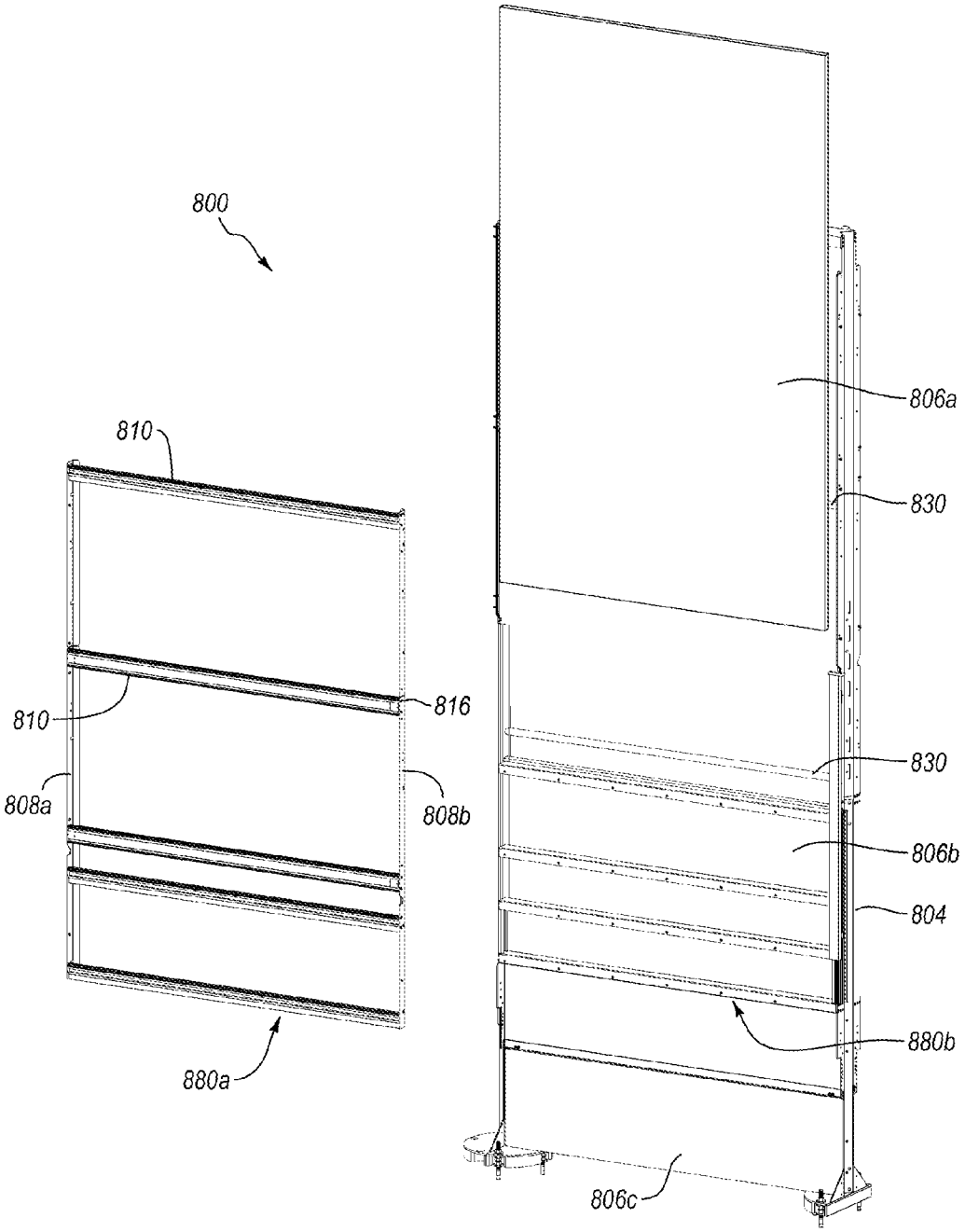
FIG. 9 illustrates a method of assembling and/or disassembling an acoustic wall module and/or modular acoustic wall in accordance with another implementation of the present invention.

Referring now to FIG. 9, in at least one implementation, the ladder or ladder frames 880*a*, 880*b* may be removed at least temporarily to remove the acoustic substrates 806*a*, 806*b* from the wall module 800. This removal is further understood in context with the vertical frame/brackets 104, 104*a*, 104*b* shown in FIGS. 2-3. Specifically, the frame 102 of FIG. 3 illustrates at least one implementation for holding the acoustic substrate 106 in place, wherein the vertical frame/brackets 104*a*, 104*b* include flattened "M" shaped brackets that enables a slotted configuration with another opposing M-shaped frame/bracket. The illustrated "M" configuration may or may not be configured for a pressure fit for the acoustic substrate, but nevertheless enables the acoustic substrate 106 to be lifted or slid out of the vertical frame upon removal of the ladder frame 880*a*, 880*b* (FIG. 9).

In addition to the foregoing, one will appreciate that implementations of the present invention can be modified in any number of ways. For example, the vertical brackets or side frame components 804 can be any length to span any ceiling height, and the ladder frames 880*a*, 880*b* can be stacked side by side or top to bottom to add horizontal and vertical structure, as desired. Accordingly, one will appreciate that implementations of the present invention can enable a manufacturer or assembler to assemble as much as needed or preferred of a wall module 800 in the factory, and then to easily assemble or stand the structure, and add the acoustic substrates 806*a*, 806*b* where desired. The assembled walls provide excellent acoustic properties without sacrificing any required structural stability or rigidity.

The present invention may be embodied and/or implemented in other specific forms without departing from its spirit or essential characteristics. The described implementations are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. An acoustic wall module, comprising:

a frame comprising one or more vertical brackets; and a plurality of wall elements configured for attachment to the frame, the plurality of wall elements comprising:

at least one acoustic substrate configured to inhibit sound from passing therethrough;

at least one substrate retaining member attachable to the frame and being configured to secure the at least one acoustic substrate to the frame, the at least one acoustic substrate being positioned between the at least one substrate retaining member and a first portion of each of the one or more vertical brackets such that the at least one acoustic substrate is compressed between the frame and the at least one substrate retaining member;

a outer element positioned between the at least one acoustic substrate and one or more of (a) the at least one substrate retaining member, and (b) the one or more vertical brackets to protect the at least one acoustic substrate;

at least one horizontal support member attached to the frame; and at least one exterior wall element configured to conceal from view at least a portion of the frame from a first vantage point, the exterior wall element being attachable to the at least one horizontal support member to secure the exterior wall element to the frame.

2. The acoustic wall module of claim 1, wherein the at least one substrate retaining member comprises:

a first substrate retaining member configured to secure the at least one acoustic substrate to the frame by pressing a first end of the at least one acoustic substrate against a first vertical bracket of the frame, and a second substrate retaining member configured to secure the at least one acoustic substrate to the frame by pressing a second end of the at least one acoustic substrate against a second vertical bracket of the frame.

3. The acoustic wall module of claim 2, wherein a first end of the at least one horizontal support member is attached to the first substrate retaining member and a second end of the at least one horizontal support member is attached to the second substrate retaining member, such that the at least one horizontal support member is attached to the frame via the first and second substrate retaining members.

4. The acoustic wall module of claim 3, wherein the first and second substrate retaining members and the at least one horizontal support member comprise a ladder frame, the ladder frame being configured for selective attachment to the frame by means of the first and second substrate retaining members.

5. The acoustic wall module of claim 1, wherein the at least one substrate retaining member is spaced apart from the first portion of each of the one or more vertical brackets by the at least one acoustic substrate.

6. The acoustic wall module of claim 5, wherein the at least one acoustic substrate is at least partially secured to the frame through a compressive force applied by the at least one substrate retaining member.

7. The acoustic wall module of claim 1, wherein the at least one acoustic substrate is at least partially secured to the frame through one or more of (a) a compressive force, (b) a frictional force, (c) an adhesive, and (d) a fastener.

8. The acoustic wall module of claim 1, wherein the one or more vertical brackets comprise an angled configuration providing a plurality of surfaces in a plurality of planes, and wherein the plurality of surfaces are configured for attachment of the plurality of wall elements.

9. The acoustic wall module of claim 8, wherein the at least one acoustic substrate is secured to a first surface of the one or more vertical brackets and the at least one horizontal support member is attached to a second surface of the one or more vertical brackets.

10. The acoustic wall module of claim 9, wherein the at least one acoustic substrate comprises one or more chamfered ends complimentary to the first surface of the one or more vertical brackets.

11. The acoustic wall module of claim 9, wherein the one or more vertical brackets comprise an extended V-shaped configuration, comprising:

a V-shaped element including a first arm and a second arm arranged at a first angle such that the vertical bracket comprises a concave portion on a first side of the V-shaped element and a convex portion on an opposing second side of the V-shaped element; and a first extension element extending from the first arm at a second angle and in a first direction.

12. The acoustic wall module of claim 11, wherein the at least one acoustic substrate is positioned between the at least one substrate retaining member and the first arm of the one or more vertical brackets.

13. The acoustic wall module of claim 11, wherein the at least one horizontal support member is attached to the first extension element extending from the first arm of the one or more vertical brackets.

14. The acoustic wall module of claim 11, further comprising a bracket reinforcement member attached to the concave portion of the one or more vertical brackets, wherein the bracket reinforcement member is configured to support the first arm and the second arm of the one or more vertical brackets and to prevent the first angle at which the first arm and a second arm are arranged from changing in at least a first direction.

15. The acoustic wall module of claim 11, wherein:

the at least one substrate retaining member comprises an angled configuration including a first arm and a second arm arranged at an angle, the first arm of the substrate retaining member comprising first and second opposing surfaces, the first surface being attached to the at least one horizontal support member and the second surface being attached to the first extension element of the one or more vertical brackets such that the first arm is disposed between the at least one horizontal support member and the first extension element of the one or more vertical brackets; and the at least one acoustic substrate is positioned between at least part of the second arm of the at least one substrate retaining member and at least part of the first arm of the one or more vertical brackets.

16. The acoustic wall module of claim 1, wherein the frame is configured for attachment to a frame of an adjoining wall module.

17. The acoustic wall module of claim 1, wherein the at least one acoustic substrate comprises an MDF sheet material.

18. An acoustic wall module, comprising:

a frame having a first side and a second side;

first and second acoustic substrates, the first acoustic substrate being securable to the first side of the frame, and the second acoustic substrate being securable to the second side of the frame;

first and second substrate retaining ladder frames, the first substrate retaining ladder frame being configured to secure the first acoustic substrate to the first side of the frame, and the second substrate retaining ladder frame being configured to secure the second acoustic substrate to the second side of the frame;

first and second exterior wall elements, the first exterior wall element being connectable to the frame or the first substrate retaining ladder frame to substantially conceal from view at least a portion of the frame and the first acoustic substrate from a first vantage point, and the second exterior wall element being connectable to the frame or the second substrate retaining ladder frame to substantially conceal from view at least a portion of the frame and the second acoustic substrate from a second vantage point;

wherein:

the frame comprises first and second vertical brackets and one or more support members connected between the first and second vertical brackets;

each of the first and second substrate retaining ladder frames comprises first and second substrate retaining members and one or more horizontal support members connected therebetween;

each of the first and second substrate retaining members comprises an angled configuration including a first arm and a second arm arranged at an angle;

the first acoustic substrate is disposed between the first vertical bracket and the first substrate retaining member of the first substrate retaining ladder frame and between the second vertical bracket and the second substrate retaining member of the first substrate retaining ladder frame; and the second acoustic substrate is disposed between the first vertical bracket and the first substrate retaining member of the second substrate retaining ladder frame and between the second vertical bracket and the second substrate retaining member of the second substrate retaining ladder frame.

19. The acoustic wall module of claim 18, wherein the first arm of each of the first and second substrate retaining members is configured to be secured to the frame.

20. The acoustic wall module of claim 18, wherein the first and second acoustic substrates are secured to the frame by being compressed between at least a portion of the frame and at least a portion of the second arms of the substrate retaining members.

21. An acoustic wall module, comprising:

a frame comprising one or more vertical brackets having an extended V-shaped configuration, comprising;

a V-shaped element including a first arm and a second arm arranged at a first angle such that the vertical bracket comprises a concave portion on a first side of the V-shaped element and a convex portion on an opposing second side of the V-shaped element; and a first extension element extending from the first arm at a second angle and in a first direction; and a plurality of wall elements configured for attachment to the frame, the plurality of wall elements comprising:

at least one acoustic substrate configured to inhibit sound from passing therethrough;

at least one substrate retaining member attachable to the frame and being configured to secure the at least one acoustic substrate to the frame, the at least one acoustic substrate being positioned between the at least one substrate retaining member and a first portion of each of the one or more vertical brackets such that the at least one acoustic substrate is compressed between the frame and the at least one substrate retaining member;

a outer element positioned between the at least one acoustic substrate and one or more of (a) the at least one substrate retaining member, and (b) the one or more vertical brackets to protect the at least one acoustic substrate;

at least one horizontal support member attached to the frame; and at least one exterior wall element configured to conceal from view at least a portion of the frame from a first vantage point, the exterior wall element being attachable to the at least one horizontal support member to secure the exterior wall element to the frame.

22. The acoustic wall module of claim 21, wherein the at least one acoustic substrate is positioned between the at least one substrate retaining member and the first arm of the one or more vertical brackets.

23. The acoustic wall module of claim 21, wherein the at least one horizontal support member is attached to the first extension element extending from the first arm of the one or more vertical brackets.

24. The acoustic wall module of claim 21, further comprising a bracket reinforcement member attached to the concave portion of the one or more vertical brackets, wherein the bracket reinforcement member is configured to support the first arm and the second arm of the one or more vertical brackets and to prevent the first angle at which the first arm and a second arm are arranged from changing in at least a first direction.

* * * * *